US009982403B2

(12) United States Patent
Price

(10) Patent No.: US 9,982,403 B2
(45) Date of Patent: May 29, 2018

(54) VEHICLE BARRIER APPARATUS

(71) Applicant: The United States of America as Represented by the Secretary of the Army, Washington, DC (US)

(72) Inventor: Christopher G. Price, Vicksburg, MS (US)

(73) Assignee: The United States of America as Represented by The Secretary of The Army, Washington, DC (US)

( * ) Notice: Subject to any disclaimer, the term of this patent is extended or adjusted under 35 U.S.C. 154(b) by 0 days. days.

(21) Appl. No.: 15/156,065

(22) Filed: May 16, 2016

(65) Prior Publication Data

US 2017/0130411 A1 May 11, 2017

Related U.S. Application Data

(63) Continuation-in-part of application No. 15/135,312, filed on Apr. 21, 2016.

(60) Provisional application No. 62/253,587, filed on Nov. 10, 2015.

(51) Int. Cl.

| | |
|---|---|
| ***E01F 13/12*** | (2006.01) |
| ***E01F 13/02*** | (2006.01) |
| ***E01F 15/00*** | (2006.01) |

(52) U.S. Cl.

CPC ..... *E01F 13/12* (2013.01); *E01F 13/02* (2013.01); *E01F 13/123* (2013.01); *E01F 15/00* (2013.01)

(58) Field of Classification Search

CPC ..... E01F 13/12; E01F 13/02; E01F 13/123; E01F 15/00; E01F 15/148; E01F 15/10; E01F 15/12; E01F 9/0122; E01F 9/012; E01F 9/0175

See application file for complete search history.

(56) References Cited

U.S. PATENT DOCUMENTS

| | | | | |
|---|---|---|---|---|
| 3,508,371 A * | 4/1970 | Meyer | F16B 5/0642 | 24/295 |
| 4,490,069 A * | 12/1984 | Cushman | E01F 9/529 | 404/15 |
| 4,828,424 A * | 5/1989 | Crisp, Sr. | E01F 13/123 | 404/6 |
| 6,206,608 B1 * | 3/2001 | Blevins | E01F 13/12 | 404/6 |
| 6,220,781 B1 * | 4/2001 | Miller | E01F 13/12 | 404/6 |
| 6,409,420 B1 * | 6/2002 | Horton | E01F 13/123 | 404/6 |

(Continued)

*Primary Examiner* — Abigail A Risic

(74) *Attorney, Agent, or Firm* — Brian C Jones

(57) ABSTRACT

A vehicle barrier apparatus includes a horizontal barrier component, a vertical barrier component, at least one rigid stabilizer beam having two end surfaces and at least one elongated side surface. One end of the stabilizer beam is affixed to the vertical barrier component. The elongated side surface of the stabilizer beam is affixed to the horizontal barrier component to prevent rotational movement of the vertical barrier component. A lower surface of the horizontal barrier component is a friction-enhanced surface which creates a sliding friction interface upon contact of a moving vehicle with the vertical barrier component. The horizontal barrier is made up of panel components interconnected by link components.

20 Claims, 3 Drawing Sheets

(56) References Cited

U.S. PATENT DOCUMENTS

Figure 1A:
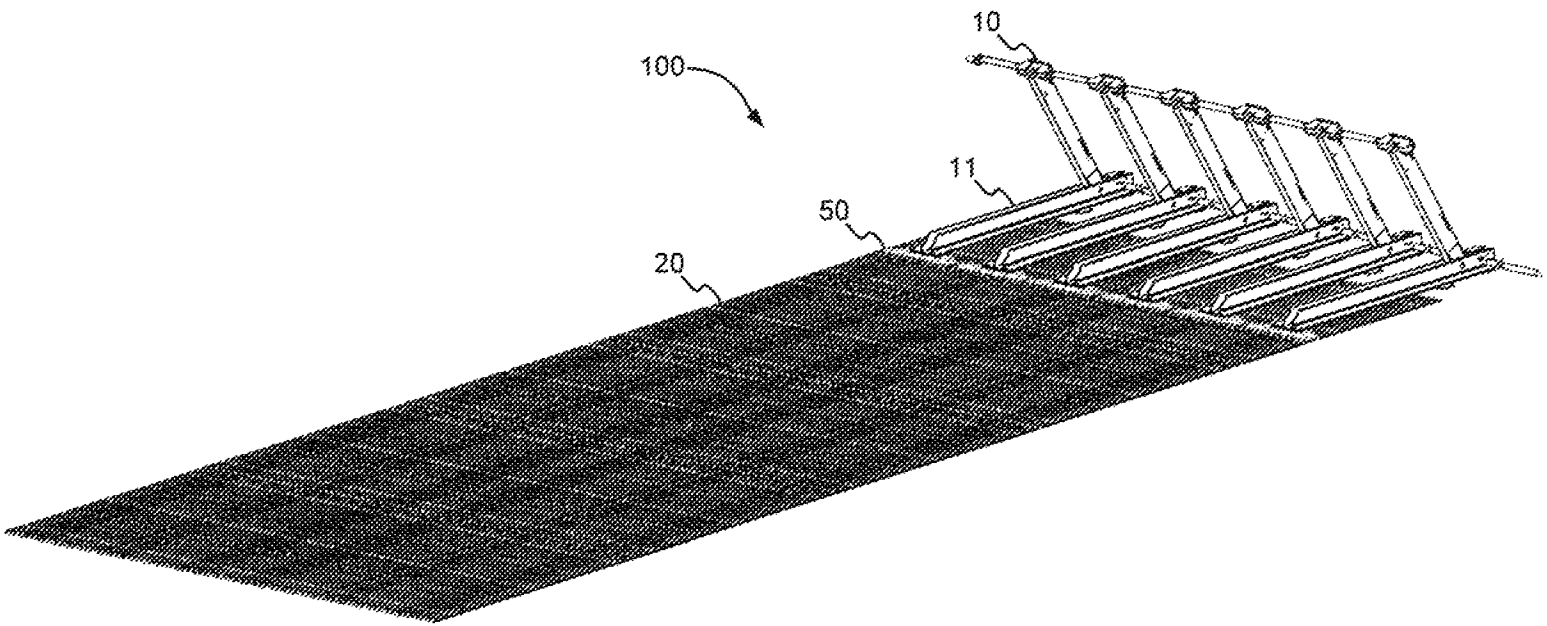

| | | | | |
|---|---|---|---|---|
| 7,736,086 | B2 * | 6/2010 | Coomber | E01F 13/12 404/6 |
| 8,469,627 | B2 * | 6/2013 | Castro | E01F 13/12 404/6 |
| 2006/0140715 | A1 * | 6/2006 | Lyddon | E01F 13/12 404/6 |
| 2006/0179785 | A1 * | 8/2006 | Stewart | F16B 21/09 52/699 |
| 2008/0060271 | A1 * | 3/2008 | Beniamin | E01F 13/12 49/34 |
| 2009/0317185 | A1 * | 12/2009 | Coomber | E01F 13/12 404/6 |
| 2012/0177439 | A1 * | 7/2012 | More | E01F 13/12 404/6 |
| 2014/0301781 | A1 * | 10/2014 | Lindberg | E01F 15/146 404/6 |

* cited by examiner

Figure 1c
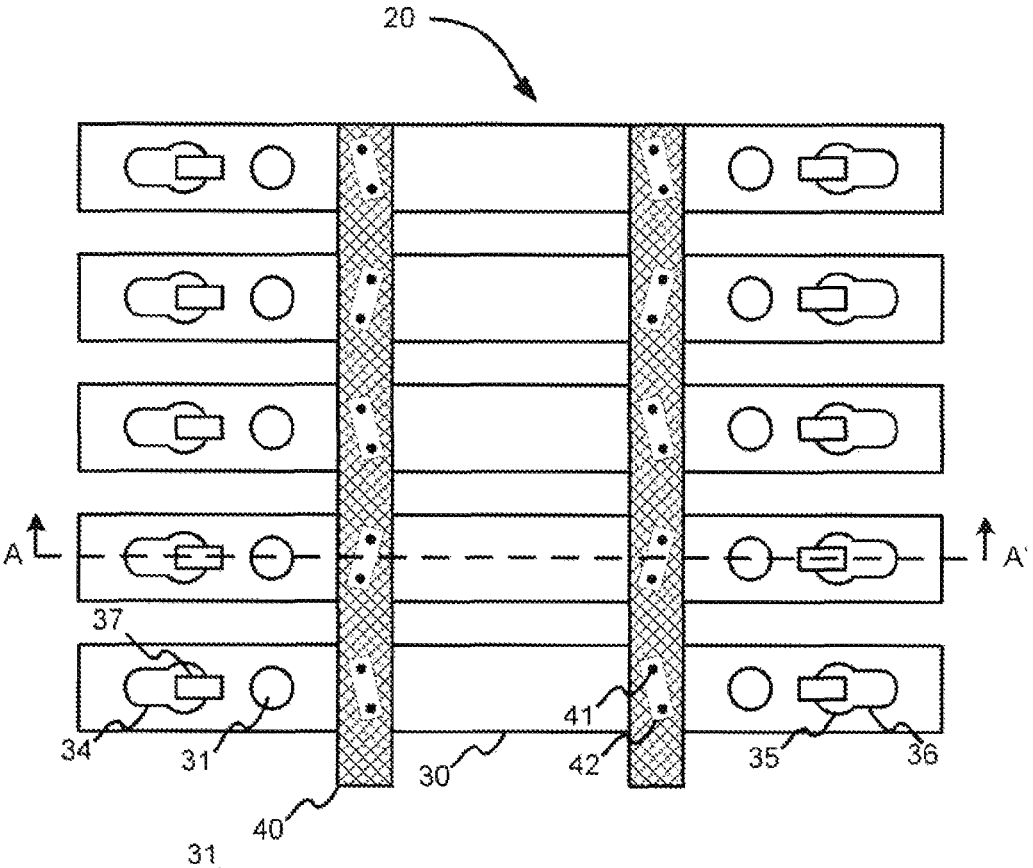
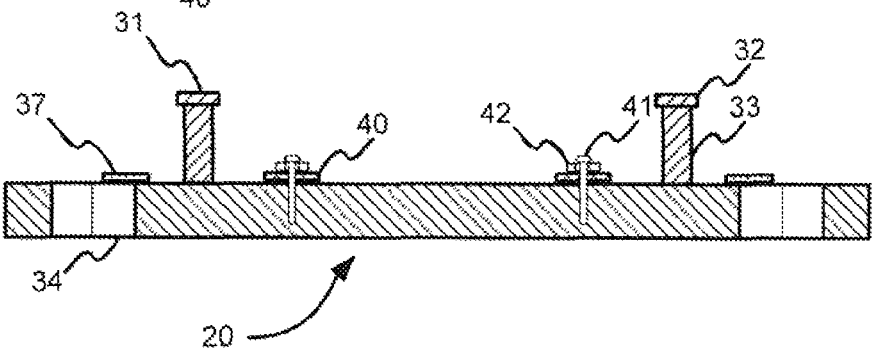
Figure 1d

VEHICLE BARRIER APPARATUS

CROSS-REFERENCE TO RELATED APPLICATIONS

This patent application is a continuation-in-part of U.S. application Ser. No. 15/135,312 filed Apr. 21, 2016. This patent application claims the benefit of U.S. Provisional Application No. 62/253,587 filed Nov. 10, 2015. The above applications are incorporated by reference herein in their entirety.

STATEMENT REGARDING FEDERALLY SPONSORED RESEARCH OR DEVELOPMENT

The invention described herein was made by an employee of the United States Government and may be manufactured and used by the Government of the United States of America for, governmental purposes without the payment of any royalties thereon or therefore.

BACKGROUND OF THE INVENTION

1. Field of Invention

This invention relates to the field of rapidly deployable traffic barriers (referred to as "expedient barriers") which bring vehicles to a controlled stop by interfering with tire rolling.

2. Description of Related Art

Vehicle checkpoints, roadblocks and barriers (i.e., "barriers" generally) manned by military personnel and/or law enforcement are becoming increasingly commonplace in the world we live in. There are several objectives of the barriers. To the greatest, extent possible, the personnel who are operating the barriers must be protected from threats, typically associated with the vehicles and occupants the barriers are designed to stop. Of course, barriers usually serve to protect personnel and facilities within an established perimeter or region.

Often, in a crisis, expedient barriers must be rapidly deployed. As a result, vehicles containing peaceful civilians or other local police or military personnel may unexpectedly encounter an expedient barrier where none previously existed, be caught by surprise and fail to appropriately slow down.

The US military has consistently sought solutions for rapid deployment of vehicle barriers. The US Army Corps of Engineers, Naval Facilities Engineering Command, the US Air Force and the State Department have conducted research to design effective barrier devices, without regard to the use of other physical mechanisms to prevent a vehicle from breaching a checkpoint. Research has primarily focused on the development of barricade structures.

U.S. Patent Application No. 2014/0301781 to Lindberg et al proposed the use of both a ground barrier and upright vertical barrier to slow an approaching vehicle. Lindberg utilized a rebar ground barrier capable of supporting the weight of vehicles. This structure requires significant cargo space to accommodate its shape, and requires several persons to deploy it on site. Once in place, it is difficult to move or reconfigure the structure.

There is an unmet need for rapidly deployable and easily stored equipment at checkpoints which can safely and reliably stop a speeding vehicle at a checkpoint.

There is a further unmet need for modular equipment which can accommodate numerous road sizes and configurations.

BRIEF SUMMARY OF THE INVENTION

A vehicle barrier apparatus includes a horizontal barrier component, a vertical barrier component, at least one rigid stabilizer beam having two end surfaces and at least one elongated side surface. One end of the stabilizer beam is affixed to the vertical barrier component. The elongated side surface of the stabilizer beam is affixed to the horizontal barrier component to prevent rotational movement of the vertical barrier component. The horizontal barrier component is made up of panel components interconnected by link components extending across the panel components. A lower surface of the horizontal barrier component is a friction-enhanced surface which creates a sliding friction interface upon contact of a moving vehicle with the vertical barrier component.

BRIEF DESCRIPTION OF SEVERAL VIEWS OF THE DRAWING(S)

FIG. 1*a* illustrates a perspective view of an exemplary embodiment of a vehicle barrier apparatus.

Figure 1B:
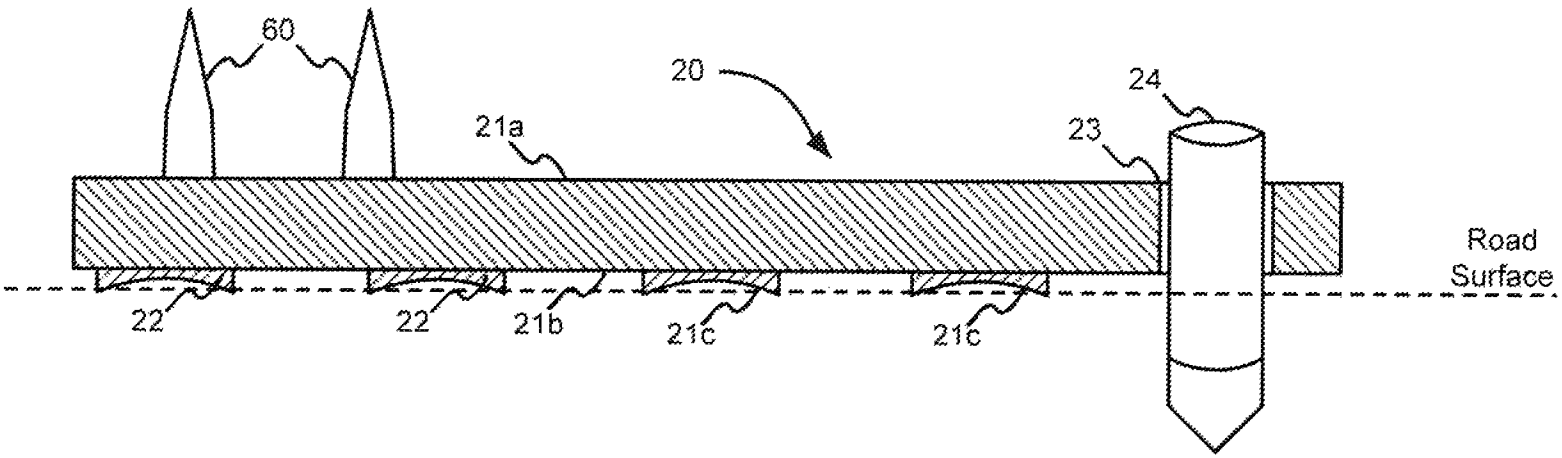

FIG. 1*b* is a sectional view of an exemplary embodiment of horizontal barrier component.

FIGS. 1*c* and 1*d* are top and sectional views, respectively, of the exemplary embodiment of the horizontal barrier component.

DETAILED DESCRIPTION OF THE INVENTION

FIG. 1*a* illustrates a perspective view of an exemplary embodiment of vehicle barrier apparatus 100. FIG. 1*b* is a sectional view of an exemplary embodiment of horizontal barrier component 20. FIGS. 1*c* and 1*d* are top and sectional views, respectively, of the exemplary embodiment of horizontal barrier component 20.

Vehicle barrier apparatus 100 includes at least one vertical barrier component 10, at least one stabilizer beam 11, and at least one horizontal barrier component 20 connected to at least one optional spreader bar 50. Certain embodiments of vehicle barrier apparatus 100 include multiple vertical barrier components 10, multiple stabilizer beams 11, multiple horizontal barrier, components 20 and/or multiple spreader bars 50.

Vertical barrier component 10 is a rigid component extending at least partially in a vertical direction relative to a road surface. Vertical barrier component 10 has a minimum vertical height equal to a height of a target vehicle bumper, allowing vertical barrier component 10 to come into contact with and restrict the target vehicle motion.

Stabilizer beam 11 has length greater than a height of the target vehicle bumper, preventing vertical barrier component 10 from rotating when hit by the target vehicle. In certain embodiments, vertical barrier component 10 has a movable connection to stabilizer beam 1 to alter an angle between vertical barrier component 10 and stabilizer beam 11. In the exemplary embodiment, the movable connection is a hinged or pinned movable connection between vertical barrier component 10 and stabilizer beam 11. Vertical barrier component 10 forms an angle with stabilizer beam 11 ranging from approximately 15 degrees to approximately 90 degrees. In certain embodiments, springs, pneumatic or hydraulic cylinders, or other actuating components between vertical barrier component 10 and stabilizer beam 11 to allow rapid setup of vehicle barrier apparatus 100.

Horizontal barrier component 20 is a structure capable of preventing rolling of a vehicle tire relative to the road surface, beneath the tire when placed between the vehicle tire and the road surface. Horizontal barrier component 20 may be constructed of metal, fabric, nylon, other polymers, resins, carbon fiber or composites thereof. Because horizontal barrier component 20 prevents contact between the target vehicle and a road surface, vehicle barrier apparatus 100 skids along the road surface under the target vehicle's momentum. In certain embodiments, a plurality of modular horizontal barrier components 20 connect together to accommodate larger sizes of vehicle barrier apparatus 100.

Horizontal barrier component 20 may be a rigid or flexible structure, or composed of a plurality of substructures that are themselves rigid or flexible. A flexible structure is non-rigid and/or deformable, or comprised of components capable of being moved or repositioned without breakage. A flexible structure is one capable of being bent, flexed, twisted or folded to alter its shape or position and reduce the amount of space necessary for storage. Because a flexible horizontal barrier component 20 can be, rolled or folded, it is easy to transport and maneuver into place. A rigid horizontal barrier component 20 can be easily manufactured from one or more sections of rigid material.

Horizontal barrier component 20 is affixed to stabilizer beam 11. Affixation is the connection of horizontal barrier component 20 to stabilizer beam 11 by means of cables, threaded and unthreaded connectors, male-female connecting structures, and any other connecting means known in the art. In certain embodiments, horizontal barrier component 20 is selectively affixed to stabilizer beam 11, allowing for replacement. In certain embodiments, horizontal barrier component 20 is permanently affixed to stabilizer beam 11. Horizontal barrier component 20 has a barrier length greater than wheelbase of the target vehicle, and a barrier width greater than an axle track of the target vehicle.

In certain embodiments where horizontal barrier component 20 is flexible, horizontal barrier component 20 is also attached to spreader bar 50. Because horizontal barrier component 20 includes a tension force when attached to spreader bar 50, it is "under tension" and does not roll or otherwise contract during use. Spreader bar 50 keeps a flexible horizontal barrier component 20 from rolling up or otherwise deforming during use. In the exemplary embodiment, spreader bar 50 is integrated with vertical barrier component 10 and/or stabilizer beam 11. In other embodiments, spreader bar 50 is separate from vertical barrier component 10 and/or stabilizer beam 11.

As shown in FIG. 1*b*, horizontal barrier component 20 includes an upper barrier surface 21*a* and a lower barrier surface 21*b* having a friction-enhanced surface 21*c*. Friction-enhanced surface 21*c* is a surface which increases friction between horizontal barrier component 20 and the road surface. Upon contact of a moving vehicle with vertical barrier component 10, friction-enhanced surface 21*c* creates a sliding friction interface, at least one physical point of sliding contact between friction-enhanced surface 21*c* and the road surface. Friction-enhanced surface 21*c* has a minimum coefficient of kinetic friction with a road surface of approximately 0.3. In certain embodiments, friction-enhanced surface 21*c* includes at least one frictional structure 22, which increases the coefficient of kinetic friction between the road surface and horizontal, barrier component 20. Frictional structures 22 can include metal grating, at least one layer of elastomer, integral metal protrusions, welded metal angles or bolted metal angles.

In certain embodiments, horizontal barrier component 20 includes reduction apertures 23 extending from upper barrier surface 21*a* to lower barrier surface 21*b*. Reduction aperture 23 is a chamber, cavity or structural configuration which minimizes material and reduces weight. An average diameter of reduction apertures 23 is inversely proportional to a road roughness surface coefficient $K_s$ calculated by the equation:

$$K_s = \frac{\sum_{i=1}^{i=n} (b_i - a)^2}{n}$$

wherein b is the height of a road surface at a measurement point i, a is the average height of the road surface and n is the total number of measurement points i.

In certain embodiments, at least one barrier anchor 24 may pass through reduction aperture 23 into a road surface below. Barrier anchor 24 is a stake picket, peg, or other anchor capable of fixing horizontal barrier component 20 to a road surface, increasing the force required to move horizontal barrier component 20. In certain embodiments, horizontal barrier component 20 also includes a vehicle disabling mechanism 60 on upper barrier surface 21*a*. Vehicle disabling mechanism 60 may include spike strips or other tire deflation devices, or a mechanism which prevents a target vehicle from disengaging from vehicle barrier apparatus 100.

As shown in shown in FIGS. 1*c* and 1*d*, horizontal barrier component 20 is made up of a plurality of panel components 30 connected by link components 40. This allows horizontal barrier component 20 to be folded or rolled into a more compact configuration for easier storage, transport and placement. In certain embodiments, panel components 30 are modular. In one embodiment, panel components 30 are metallic panel components made from aluminum.

In the exemplary embodiment, panel components 30 are strips of 6061-T6 aluminum having a width of 1.25 inches and gap of 0.75 inches between panel components 30. In the exemplary embodiment, link components 40 are nylon straps having a width of 1 inch. While the exemplary embodiment shows two link components connecting five panel components 30, other embodiments may include more or fewer of each.

In certain embodiments, link components 40 are connected to panel components 30 by panel connectors 41. Panel connectors 41 may be removable or non-removable rivets, bolts, screws, pins, or any other means of connection known in the art. In certain embodiments, panel connectors 41 may at least partially extend through a reinforcing plate 42 located atop link component 40. This configuration prevents link components 40 from tearing free of panel components 30 and panel connectors 41.

In various embodiments, panel components 30 or link components 40 may include reduction apertures 23 or be configured to reduce weight, or to increase structural integrity. Link components 40 may be manufactured from polymer straps. In other embodiments, link components 40 are a plurality of woven metal wires. The plurality of woven metal wires includes coated steel wires or chain link fencing. In still another embodiment, link components 40 are meshes of a para-aramid synthetic fiber. A mesh is a material made of woven or connected fibers, strands, wires, tapes, strips, fabric, metal or other materials or other components which are structurally integrated, interwoven, crossed, twisted, interlocking, interconnected or otherwise structurally integrated or attached. Link components 40 may have an asymmetrical or symmetrical configuration, and may have a sinuous or triangular waveform configuration.

In the embodiment shown in FIGS. 1*c* and 1*d*, horizontal barrier component 20 is modular and can be connected to other horizontal barrier components 20. A connection protrusion 31 extends from panel component 30. Connection protrusion 31 has a protrusion head 32 and a protrusion neck 33 sized to allow insertion into a keyhole aperture 34 in another horizontal barrier component 20. The shape of keyhole aperture 34 is that of a circle or oval having a first diameter partially merged with a circle or oval having a second, smaller diameter, resulting in keyhole aperture 34 having a large diameter end 35 and a small diameter end 36.

The diameter of protrusion neck 33 is smaller than the diameter of small diameter end 36, which is smaller than the diameter of protrusion head 32 which is smaller than the diameter of large diameter end 35. A retaining clip 37 extends at least partially over keyhole aperture 34. Retaining clip 37 is an at least semi-flexible tab of metal connected to a panel component 30. Similar arrangements of connection protrusions 31 and/or keyhole apertures 34 may be present on stabilizer beam 11 to allow connection of horizontal barrier component 20 to stabilizer beam 11.

When connecting two horizontal barrier components 20, protrusion head 32 passes vertically through large diameter end 35, then protrusion neck 33 moves horizontally into small diameter end 36. Insertion of connection protrusion 31 forcibly moves retaining clip 37 away from keyhole aperture 34. Retaining clip 37 snaps back into position after passage of protrusion head 32 and/or movement of protrusion neck 33 in keyhole aperture 34. Retaining clip 37 thereby partially blocks keyhole aperture 34 and prevents inadvertent removal of connection protrusion 31.

It will be understood that many additional changes in the details, materials, procedures and arrangement of parts, which have been herein described and illustrated to explain the nature of the invention, may be made by those skilled in the art within the principle and scope of the invention as expressed in the appended claims. Moreover, the term "approximately" as used herein may be applied to modify any quantitative representation that could permissibly vary without resulting in a change in the basic function to which it is related.

It should be further understood that the drawings are not necessarily to scale; instead, emphasis has been placed upon illustrating the principles of the invention. Moreover, details from one drawing may be omitted from another drawing for clarity.

What is claimed is:

1. A vehicle barrier apparatus, comprising:

at least one vertical barrier component, wherein said at least one vertical barrier component is rigid;

at least one horizontal barrier component having a length greater than a wheelbase of a target vehicle and a width greater than an axle track of said target vehicle, and being capable of preventing the rolling of a vehicle tire relative to a surface beneath said tire including a plurality of panel components interconnected by a plurality of link components extending across said plurality of panel components, wherein said at least one horizontal barrier component includes a lower barrier surface having a friction-enhanced surface, wherein said friction-enhanced surface creates a sliding friction interface upon contact of a moving target vehicle with said at least one vertical barrier component; and at least one stabilizer beam having two end surfaces and at least one elongated side surface, wherein one end of said stabilizer beam is affixed to said at least one vertical barrier component, wherein said at least one elongated surface is affixed to said at least one horizontal barrier component to prevent rotational movement of said at least one vertical barrier component.

2. The apparatus of claim 1, wherein said at least one vertical barrier component has a minimum vertical height equal to a target vehicle bumper.

3. The apparatus of claim 1, wherein said at least one vertical barrier component and said at least one stabilizer beam are movably attached to alter an angle between said at least one vertical barrier component and said at least one stabilizer beam.

4. The apparatus of claim 3, further including an actuating component connected to said at least one vertical barrier component and said at least one stabilizer beam, wherein said actuating component is selected from the group consisting of: springs, pneumatic cylinders, and hydraulic cylinders.

5. The apparatus of claim 1, wherein said at least one vertical barrier component forms an angle with said at least one stabilizer beam ranging from approximately 15 degrees to approximately 90 degrees.

6. The apparatus of claim 1, wherein said at least one stabilizing beam is permanently affixed to said at least one horizontal barrier component.

7. The apparatus of claim 1, wherein said at least one stabilizing beam is selectively affixed to said at least one horizontal barrier component.

8. The apparatus of claim 1, wherein said friction-enhanced surface has a minimum coefficient of kinetic friction with a road surface of approximately 0.3.

9. The apparatus of claim 1, wherein said friction-enhanced surface comprises at least one frictional structure selected from the group consisting of: metal grating, at least one layer of elastomer, integral metal protrusions, welded metal angles and bolted metal angles.

10. The apparatus of claim 1, wherein said at least one horizontal barrier component further includes a plurality of reduction apertures extending therethrough.

11. The apparatus of claim 10, wherein at least one of said plurality of reduction apertures includes at least one barrier anchor extending through said at least one of said plurality of reduction apertures and into a road surface.

12. The apparatus of claim 10, wherein an average diameter of said plurality of reduction apertures is inversely proportional to a road roughness surface coefficient $K_s$ calculated by the equation:

$$K_s = \frac{\sum_{i=1}^{i=n} (b_i - a)^2}{n}$$

wherein b is the height of a road surface at a measurement point i, a is the average height of the road surface and n is the total number of measurement points i.

13. The apparatus of claim 1, wherein said at least one horizontal barrier component includes at least one vehicle disabling mechanism on an upper barrier surface.

14. The apparatus of claim 1, wherein said plurality of panel components are a plurality of metallic panel components.

15. The apparatus of claim 1, wherein said plurality of panel components are a plurality of panel components.

16. The apparatus of claim 1, wherein said plurality of link components are selected from the group consisting of: a plurality of polymer straps, a plurality of meshes of a para-aramid synthetic fiber, and a plurality of interconnected woven metal wires.

17. The apparatus of claim 1, wherein at least one of said plurality of panel components includes at least one keyhole aperture and at least one connection protrusion.

18. The apparatus of claim 17, wherein at least one retaining clip extends over at least part of said at least one keyhole aperture.

19. The apparatus of claim 1, wherein said plurality of panel components are connected to a plurality of link components by a plurality of panel connectors.

20. The apparatus of claim 19, wherein at least one of said plurality of panel connectors extends through at least one reinforcing plate, wherein said at least one reinforcing plate is in contact with at least one of said plurality of link components.

* * * * *